United States Patent [19]

Enchelmaier

[11] 4,114,221

[45] Sep. 19, 1978

[54] HELICALLY WOUND BRUSH

[76] Inventor: Harvard W. K. Enchelmaier, 4 E. Greenbrook Rd., North Caldwell, N.J. 07006

[21] Appl. No.: 724,410

[22] Filed: Sep. 17, 1976

[51] Int. Cl.[2] ..... A46B 3/08

[52] U.S. Cl. ..... 15/182; 300/2; 300/21

[58] Field of Search ..... 15/182, 183, 181, 179, 15/198, 200; 300/21, 2

[56] References Cited

U.S. PATENT DOCUMENTS

| | | | |
|---|---|---|---|
| 2,797,966 | 7/1957 | Enchelmaier | 15/182 |
| 2,817,108 | 12/1957 | Vanclief | 15/182 |
| 3,233,272 | 2/1966 | Pambelld | 15/182 |
| 3,290,714 | 12/1966 | Enchelmaier | 15/182 |

*Primary Examiner*—Robert W. Jenkins

[57] ABSTRACT

Brush where in bristle tufts are bound to a brush core by a helically wound notched strip of a suitable material such as metal spaced radially of the core, the roots of the bristle tufts passing through the notches in the strip. The strip has longitudinally spaced formations integral therewith for spacing the strip radially of the brush core, thereby avoiding the use of a further, separate strip for that purpose.

The invention also includes a machine for and a method of making the above brush. The bristle binding strip is notched as it is fed toward means for feeding bristles to the notched strip to form bristle tufts, and the bristle tufts and binding strip are fed to the brush core to be wound thereon, such notching also forming strip spacing tabs. In one embodiment (a) of the machine and method the notches and tabs are formed along only one edge of the binding strip; in another embodiment (b) of the machine and method the longitudinally spaced notches and tabs alternate from one edge of the strip to the other, bristles being fed to both edges of the strip. Each of the brushes produced by machines and methods (a) and (b) may have interfitting formations on their opposite edges whereby the strip when wound on the brush core has a sheath of interfitting convolutions of such strip, thereby presenting a stronger bristle tuft retaining and bristle root protecting layer.

10 Claims, 10 Drawing Figures

Fig. 6
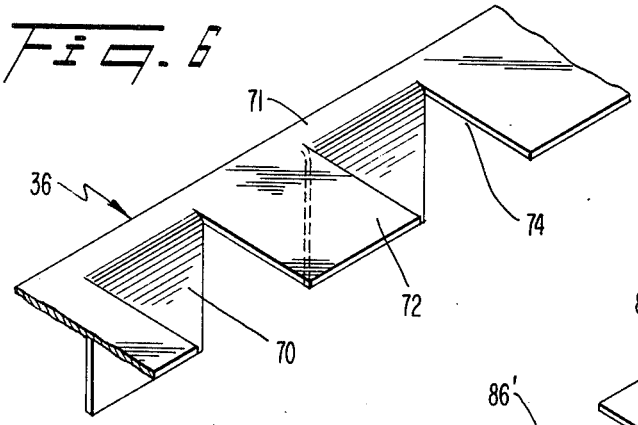
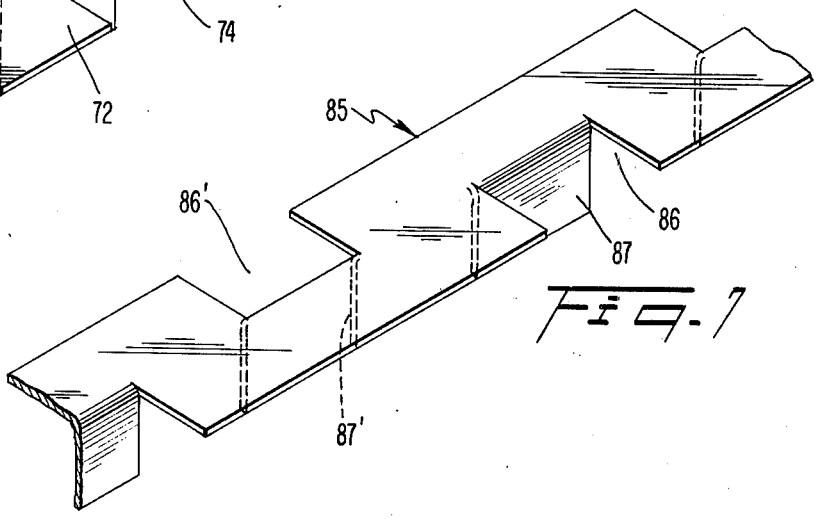
Fig. 7
Fig. 8
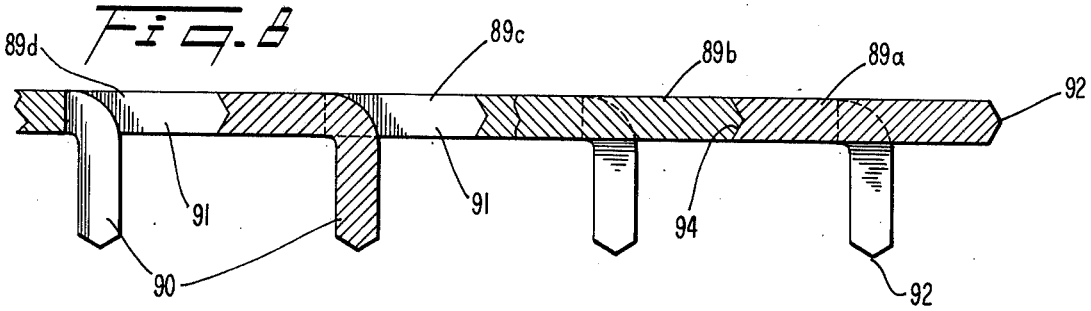
Fig. 9
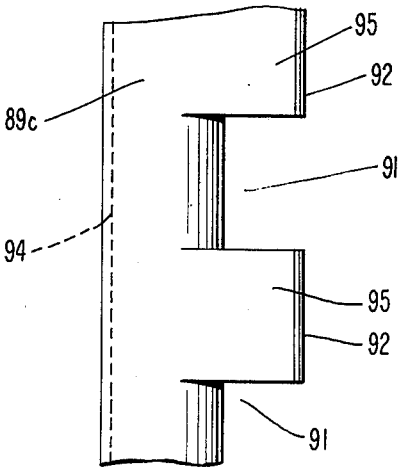
Fig. 10
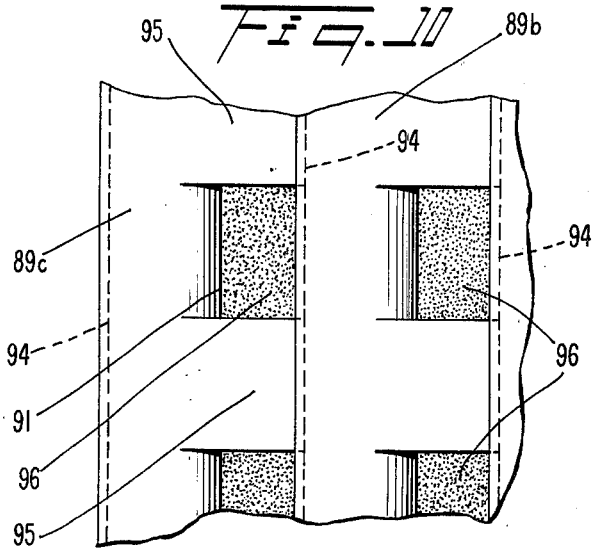

HELICALLY WOUND BRUSH

This invention relates to a brush and to an apparatus for and a method of making such brush, the brush being of the type wherein bristle tufts are bound to a brush core by a helically wound notched strip of a suitable material such as metal spaced radially of the core, the notches in the strip embracing the roots of bristle tufts which are adhesively bound to the brush core and to such notched strip.

In Enchelmaier et al U.S. Pat. No. 2,797,966, July 2, 1957, there is shown a brush of the same general type, and an apparatus for making such brush. In such prior patent there is employed not only a notched strip wound helically about a brush core, but also a second, separate upstanding corrugated strip which underlies the notched strip and is wound helically upon the brush core. Such second strip maintains the first, corrugated strip in radially spaced relationship with respect to the brush core. Not only does the employment of the second strip add to the cost of making the brush, but such brush on occasion may exhibit weaknesses in that the second, corrugated strip is bound to the first strip only by adhesive, sometimes becomes loose, and during use may even begin to separate from the brush core, the bristles, and the first strip.

In accordance with the present invention, such disadvantages of the prior art are overcome by forming the notched, bristle-retaining strip with longitudinally spaced formations which are integral with the strip, such formations positively spacing the strip radially of the core, thereby avoiding the use of a further, separate strip for that purpose.

The invention also includes a machine for and a method of making the above brush. Such machine includes means for notching the bristle-binding strip as it is fed toward the means for feeding the bristles to the notched strip to form bristle tufts and for feeding the bristle tufts and binding strip to the brush core to be wound thereon, such notching means also forming strip-spacing tabs. In one illustrative embodiment of the machine and method of the invention the notches and tabs are formed along one edge of the binding strip. In another embodiment of the machine and method the notches and tabs alternate from one edge of the strip to the other, bristles being fed to both edges of the strip.

Each of the above described brushes produced by the machine and method of the invention may have interfitting formations on their opposite edges whereby the strip when wound on the brush core presents a stronger bristle tuft tuft-retaining and bristle root protecting layer.

The above and further objects and novel features of the invention will more fully appear from the following description when the same is read in connection with the accompanying drawings. It is to be understood, however, that the drawings are for the purpose of illustration only, and are not intended as a definition of the limits of the invention.

In the drawings, wherein like reference characters refer to like parts throughout the several views:

FIG. 6 is a framentary view in perspective of the first embodiment of bristle tuft-retaining strip, such strip being notched on one edge only;

FIG. 7 is a view similar to FIG. 6 but of a second embodiment of bristle-tuft-retaining strip wherein such strip is alternately notched on its opposite edges;

FIG. 8 is a fragmentary view partially in section and partially in end elevation of a number of convolutions of a further embodiment of bristle tuft-retaining strip wherein the strip has interfitting formations on its opposite edges, the section being taken along a longitudinal plane radially of the brush, the brush core and bristles being omitted for clarity of illustration.

FIG. 9 is a fragmentary view in plan of a portion of such third embodiment of bristle tuft-retaining strip; and FIG. 10 is a fragmentary view in plan of the interfitting portions of two successive convolutions of the third embodiment of the bristle tuft-retaining strip after it has been wound upon a brush core, the roots of bristle tufts disposed in the notches of such portions of the strips being shown but the brush core being omitted.

Figure 1:
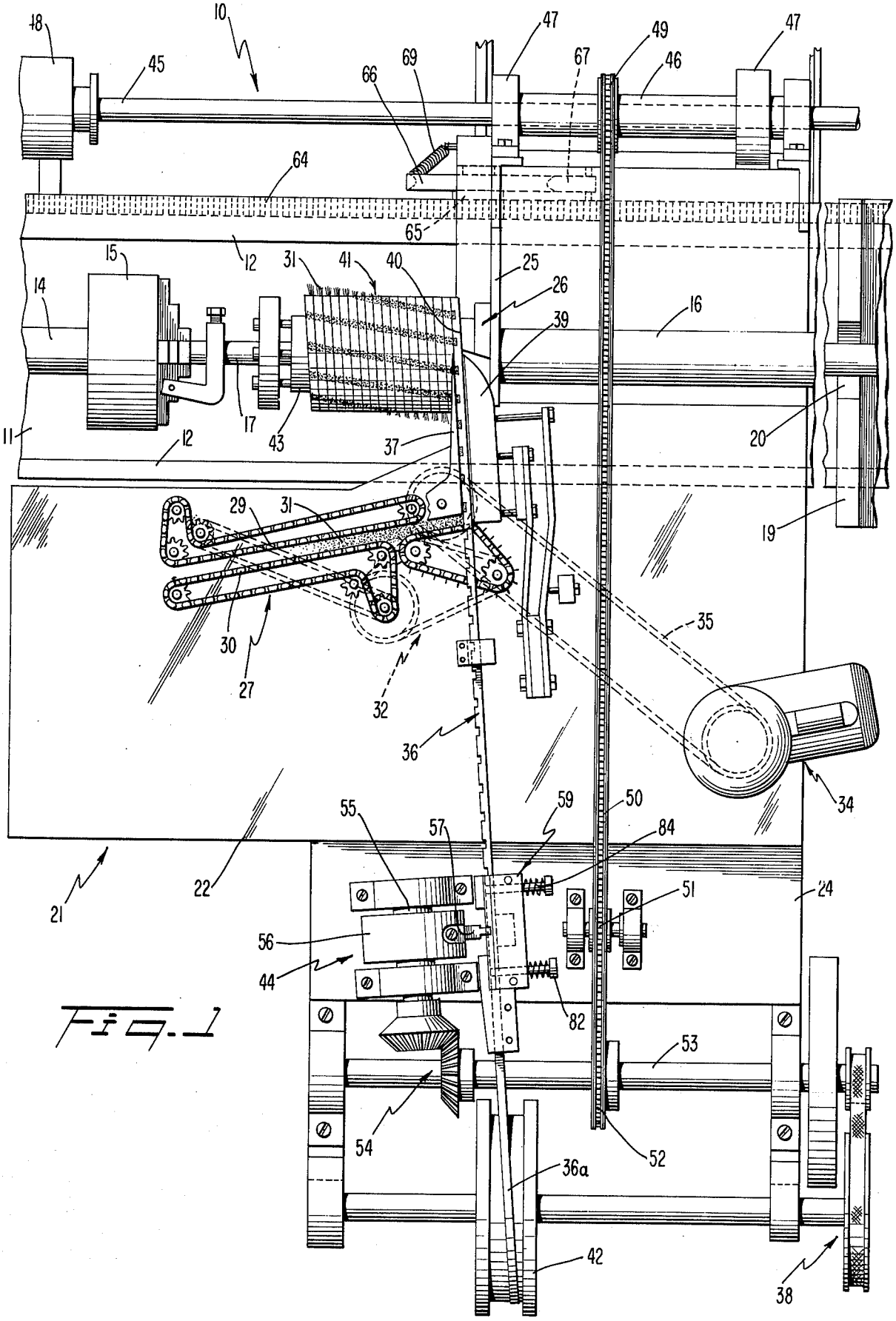
FIG. 1 is a fragmentary view in plan of a preferred embodiment of brush-making apparatus in accordance with the invention.

Turning now to FIG. 1, there is there shown a first embodiment of a lathe-like machine, generally designated 10, for forming a helically wound tuft brush wherein the bristle tufts are located and, with the aid of adhesive, retained by a helically wound strip such as shown in FIG. 6. Machine 10 has a horizontal bed 11 having spaced parallel ways 12 extending longitudinally thereof. A main shaft 14, driven and supported by means (not shown) is similar to those shown in Enchelmaier U.S. Pat. No. 2,797,966, shaft 14 bearing a chuck 15 on its inboard end. A brush core 16, which is supplied with a driving and supporting shaft 17 at the left-hand end of the brush, is rotatably supported by the chuck 15 and by a V-groove rest 20 in a support 19 which provides a bearing for a shaft similar to shaft 17 at the outboard end of the brush core.

Machine 10 has a carriage 21 which is supported upon and moves longitudinally of the ways 12, carriage 21 having a main horizontal plate 22, a front horizontal plate 24, and a transverse or cross member 25 extending rearwardly from the main horizontal plate 22. Secured to cross member 25 is a bushing 26 having an opening therethrough with a diameter slightly exceeding the outer diameter of the brush core 16, the bushing 26 having a helical left-hand face 40 which guides the notched bristle tuft-retaining strip with bristle tufts in the notches thereof as such strip and bristle tufts are wound helically upon the brush core when the core is rotated in the direction of the arrow in FIG. 1.

The machine is provided with a bristle feeding means 27 which forwards bristles 31 in a row in a direction generally from left to right as the machine is there shown, means 27 being generally the same as the bristle-feeding means in Enchelmaier et al U.S. Pat. No. 2,797,966. Thus means 27 includes bristle-feeding chains, a first, upper chain (FIG. 1) having a straight run 29 disposed between longitudinally spaced sprockets and a second, lower chain, having a straight run 30 disposed between longitudinally spaced sprockets, the two runs 29, 30 being parallel and spaced from each other to form the column of bristles 31 shown. Bristle feeding means 27 is driven by an intermediate interconnected driving means 32, means 32 being drivingly connected by a chain 35 to a geared electric motor 34 which drives bristle feeding means 27 at a speed which is generally synchronized with the speed of rotation of the brush core 16.

The bristle retaining strip, which is designated 36 after it has been notched and 36a before it has been notched, is fed from the strip-notching means 44 between a first, fixed strip-guiding means 37, at the left in FIG. 1, and a second strip-guiding means 39 which is resiliently urged toward guiding means 37 to hold the notched strip, which has now picked up tufts of bristles in its notches from the exit end of the column of bristles 31 presented to it by the bristle feeding means 27, forcibly against the fixed guide 37. Guide means 37, 39 lead the notched strip and bristle tufts accurately in alignment with the entering end of the helical face 40 of the bushing 26. Successive convolutions of the notched strip 36 with the thus retained bristle tufts forcibly engage each other in the resulting brush 41. In the embodiment shown the notches in a strip 36 are so spaced longitudinally thereof that the bristle tufts in the finished brush 40 lie in parallel rows extending helically of the brush.

Figure 4:
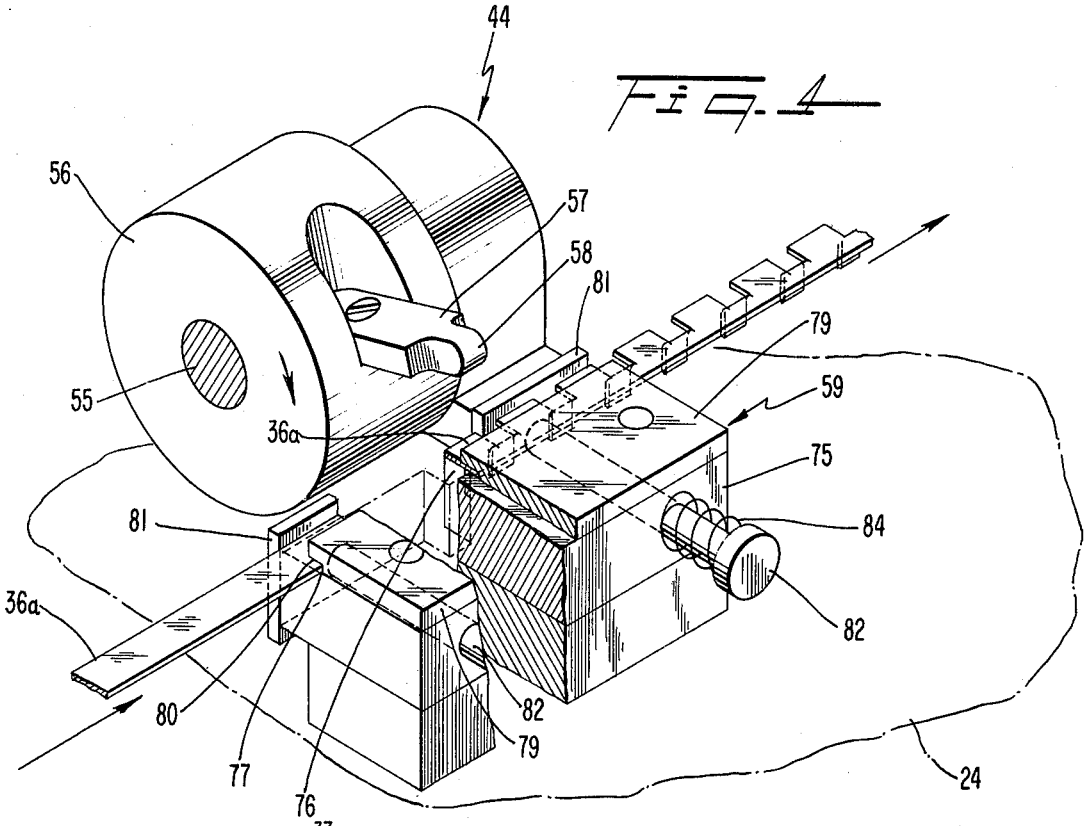
FIG. 4 is a view in perspective of the bristle tuft-retaining strip notching means shown in FIG. 1.

Unnotched strip **36*a* is supplied from a source (not shown) such as a reel and travels over a flanged guide wheel 42 which is driven by belt and pulley means 38 from a driven shaft 53. After leaving guide wheel 42, the strip 36*a* travels to the notching means 44. Means 44 is driven by a countershaft 45 which runs longitudinally of the bed of machine 10, the countershaft being driven by a variable speed gearing means such as a PIV 48 driven in synchronism with the shaft 14. A sleeve 46, which is keyed to the countershaft 45, is supported in pillow blocks 47 attached to the carriage 21 of the machine so that the sleeve 46 travels with the carriage. Secured to sleeve 46 is a sprocket 49, sprocket 49 driving a sprocket 52 affixed to shaft 53 through the medium of a chain 50 which is guided by an idle sprocket 51, as shown. A bevel gear set 54 is drivingly connected between the shaft 53 and the shaft 55 of the strip-notching means 44. The hub 56 of a rotary male notching and tab bending tool 57 is secured to the shaft 55. The outer end 58 of the tool 57 fits within the opposite cutting edges of a mating female die generally designated 59, such outer end 58 of the tool 57 being spaced from the root of the groove in the female die so that as the tool 57 rotates it forms two parallel cuts spaced longitudinally of the strip 36*a* but bends the resulting tab downwardly without cutting its root. The cooperation of the parts of the notching machine will be explained more fully hereinafter in connection with FIG. 4** of the drawings.

A female die member 75, having a notch 76 therein is secured on a pedestal mounted on the carriage 24. The female die is so mounted relative to the axis of the shaft 55 that the outer end 58 of the male tool 57 is spaced from the root 77 of the notch in the male die a distance which only slightly exceeds the thickness of the strip 36. An upper plate 79 is secured above the female die 75 has a rabbet groove 80 therein within which the rear, unnotched edge of the strip fits. The strip 36 is accurately held in the position shown by a hold down member 81 which is constantly urged to the right by coil compression springs 84 telescoped over elongated bolt members 82 which extend through bores in the female die and mount the hold down member on their outer, left-hand end.

Figure 2:
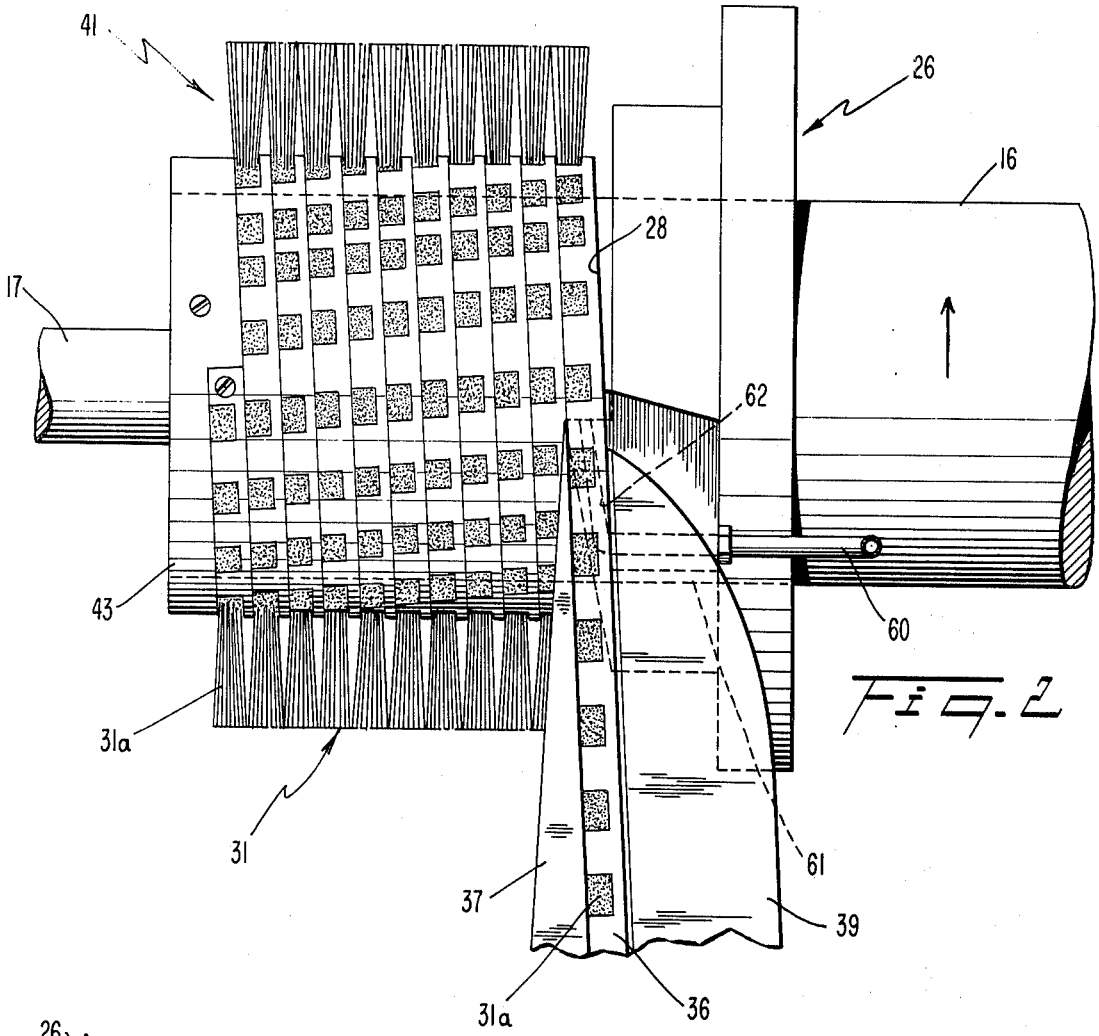
FIG. 2 is an enlarged view in plan of the portion of the apparatus as shown in FIG. 1 wherein the tufts of bristles and the bristle-retaining strip are fed to the core of the brush being formed.
Figure 3:
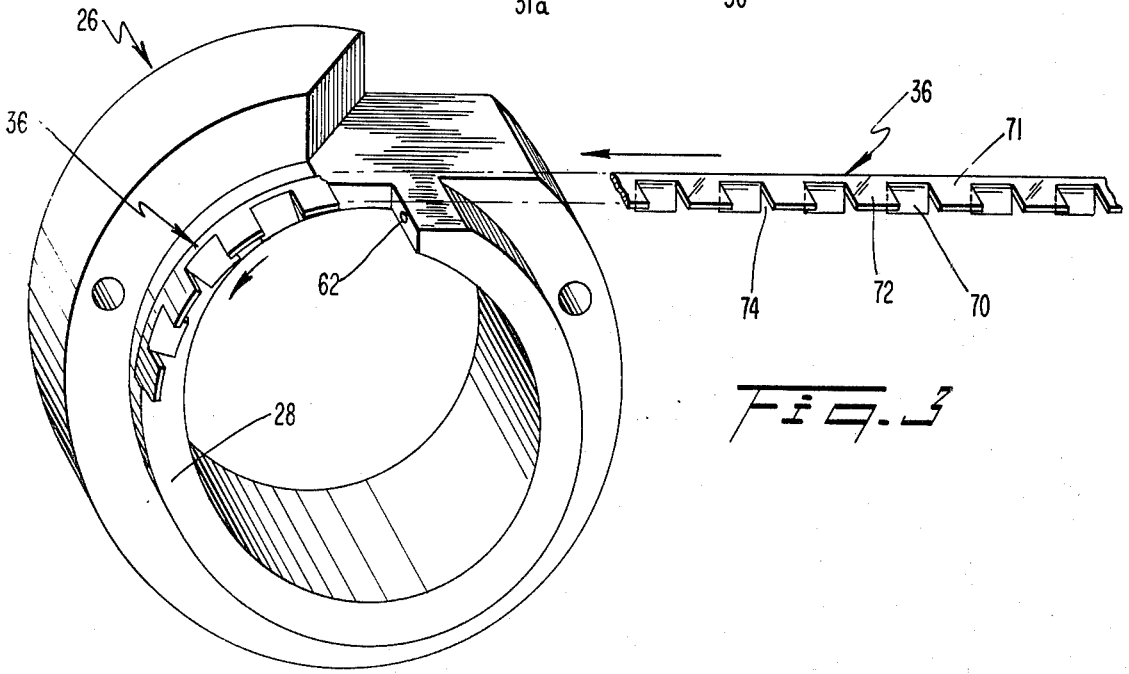
FIG. 3 is a schematic, simplified view in perspective of the helical bushing which guides the bristle tufts and bristle-retaining strip to the brush core and of the strip as it is fed toward such bushing, the brush core and bristle tufts being omitted for clarity of illustration.

As shown in FIGS. 2 and 3, an adhesive conduit 60 attached at one end to the bushing 26 leads to a first passage 61 therein and thence to a smaller connected passage 62 disposed tangential of the brush core to discharge liquid adhesive into the zone of first engagement of the bristle tufts and bristle tuft-securing strip 36 on the core of the brush. The conduit 60 is connected to a suitable adhesive supplying pump which may be driven in a manner similar to that disclosed in Enchelmaier et al U.S. Pat. No. 2,797,966.

In starting the making of a brush, the bristle tuft-retaining strip 36 is secured to a starting collar 43 on the brush core. The carriage 21 will then have been in a position to the left with the entering end of the strip 36 tightly engaged between the right-hand face of the collar 43 and the helical surface 40 of the bushing 26. As the brush core 16 turns and successive convolutions of the retaining strip and retaining bristle tufts are wound thereon, the carriage 21 is pushed to the right against the opposition of a frictional braking means such as that shown in the above Enchelmaier et al patent or against the opposition of a freely hanging weight. In the illustrative embodiment a brake is shown for this purpose. Thus the machine 10 is provided with a rack gear 64 extending parallel to the ways 12. A pinion 65 on the end of a shaft journaled in the carriage meshes with the rack gear 65. A brake wheel 66 is connected to the outer end of such shaft, such brake wheel being engaged by a brake band 67 which is constantly tensioned by a coil tension spring 69.

In the embodiment 36 of the bristle tuft-retaining strip shown in FIG. 1, 2 and 3 the strip has a continuous portion 71 along one edge thereof, these being notches 74 in one edge of the strip, such notches being spaced uniformly along the length of the strip, the strip having downbent tabs 70 extending from the roots of the respective notches and sidewardly extending tabs 72 extending between successive notches. The manner of formation of such notches and tabs has been described above in connection with FIG. 4.

Figure 5:
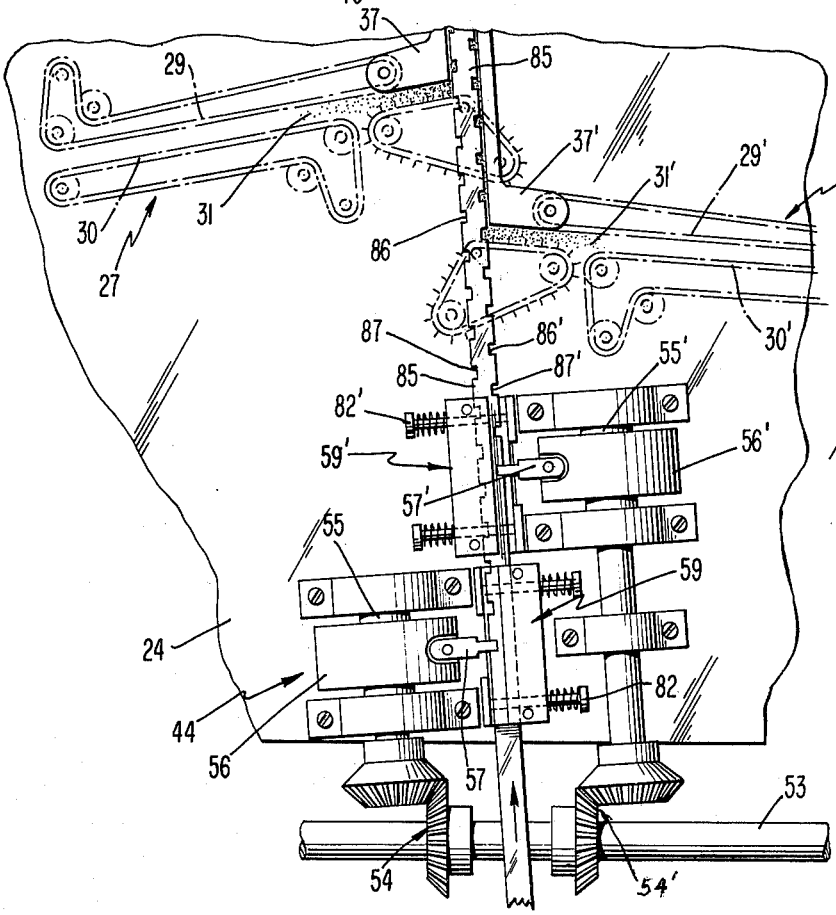
FIG. 5 is a view in plan corresponding generally to the lower portion of FIG. 1 but of a second embodiment of the brush making machine which incorporates two strip-notching means, one on each side of the strip, and separate bristle feeding means on each side of the strip.

As indicated above, modification of the machine 10 as shown in FIG. 5 produces a bristle tuft-retaining strip such as that shown at 85 in FIG. 7. Strip 85 has a series of notches 86' in the other edge of the strip, the notches 86, 86' being uniformly longitudinally spaced and alternating with each other. At notches 86 there are downbent tabs 87 and at notches 86' there are downbent tabs 87'. In the embodiment shown the tabs 87, 87' lie substantially in the central vertical plane longitudinal of the strip 85. In some instances, however, the tabs 87, 87' may lie spaced from and on opposite sides of such central plane.

The strip 85 of FIG. 7 is produced by the apparatus of FIG. 5, wherein following the strip notching means 44 there is a second strip notching means 44' and opposite the bristle feeding means 27 there is a second, oppositely disposed bristle feeding means 27'. Parts of the second strip-notching means 44' and parts of the second bristle feeding means 27' which are similar to those of units 44 and 47', respectively, are designated by the same reference characters but with added primes.

FIGS. 8, 9 and 10 illustrated a modification of the bristle tuft-retaining strip of FIG. 6. It will be apparent, however, that such modification may also be applied to the strip 85 of FIG. 7.

In FIGS. 8, 9 and 10 the strip there shown in the form of portions of succeeding convolutions of the strip has a plurality of uniformly longitudinally spaced downbent tabs 90 therein at the location of notches 91. Successive convolutions of the strip as they are shown in FIG. 8 are designated 89*a*–89*b*. One edge of such strip, which may be formed, for example, by rolling or drawing, is formed with an outwardly extending or male V-edge 92 and the other edge of the strip is formed with a mating female V-edge 94. Such V formations are shallow enough so that they present no difficulty in snapping together as the entering turn or convolution of the strip approaches the convolution of the strip which was last wound upon the brush core.

Bristle tufts 96 (FIG. 10) project through the opening presented by the notch 91 formed between successive horizontal tabs 95 on the strip and the edge of the next convolution of the bristle-retaining strip.

It will be apparent that with the exception of the apertures therein which are filled by the bristle roots, the successive convolutions of the bristle-retaining strip of FIGS. 8, 9 and 10 present a continuous metal sheath the successive convolutions of which are mechanically locked together as well as being bonded by the adhesive which bonds the strip and the bristle roots to the brush core. Although the invention has been illustrated and described with reference to a limited number of preferred embodiments thereof, it is to be expressly understood that it is in no way limited to the disclosure of such preferred embodiments, but is capable of numerous modifications within the scope of the appended claims. For example, instead of extending from the roots of the notches along an edge of the strip the tabs could, if desired, have their roots along either the forward or rear sides of the notches.

What is claimed is:

1. In a wound brush having bristle tufts bound to a brush core by a helically wound strip having longitudinally spaced edge notches therein, the bristle tufts projecting through the notches in the strip, the roots of the bristles and the strip being bonded to the brush core by a cured adhesive, the improved bristle binding strip having an edge notched main part which lies in a helix spaced from and concentric with the brush core, and a plurality of strip spacing and supporting tabs integral with the main part of the strip and extending radially inwardly therefrom, the inner free ends of the tabs engaging the core.

2. The brush of claim 1, wherein the main part of the strip and the tabs are made of sheet material, and the tabs are formed by edge notching the strip.

3. The brush of claim 2, wherein the tabs are aligned and their broad extents lie along a helicoid about the brush core.

4. The brush of claim 1, wherein the main part of the strip has interfitting formations on its opposite edges, the wound strip forming a sheath on the brush core.

5. The brush of claim 4, wherein the sheath is interrupted only by the notches in the strip.

6. The brush of claim 4, wherein the interfitting formations mate and are complimentary to each other.

7. The brush of claim 6, wherein one of the formations is a shallow projection and the other of the formations is a shallow recess, one of said formations extending along the outer free end of the unnotched portions of the notched edge of the strip, and the other of said formations extending along the length of the opposite edge of the strip.

8. The brush of claim 6, wherein the formations are of V cross section in transverse planes normal to the length of the strip.

9. The brush of claim 1, wherein the notches are disposed along only one edge of the strip.

10. The brush of claim 1, wherein the notches are disposed along both edges of the strip and notches alternate from one edge to the other of the strip along the length thereof.

* * * * *